United States Patent [19]

Fisher et al.

[11] 4,288,844

[45] Sep. 8, 1981

[54] ELECTRICALLY FOCUSED SURGICAL LIGHT

[75] Inventors: Kenneth J. Fisher; William R. Miller, both of Erie, Pa.

[73] Assignee: American Sterilizer Company, Erie, Pa.

[21] Appl. No.: 936,240

[22] Filed: Aug. 24, 1978

[51] Int. Cl.[3] ..... A61G 13/00

[52] U.S. Cl. ..... 362/33; 362/3; 362/11; 362/13; 362/18; 362/227; 362/233; 362/295; 362/297; 362/804

[58] Field of Search ..... 362/33, 294, 298, 804, 362/295, 3, 8, 11, 13, 18, 297, 296, 227, 233; 315/291, 294, 313

[56] References Cited

U.S. PATENT DOCUMENTS

| | | | |
|---|---|---|---|
| 2,263,162 | 11/1941 | Collins | 315/294 |
| 3,221,214 | 11/1965 | Wolff et al. | 315/294 |
| 3,763,394 | 10/1973 | Blanchard | 315/294 |
| 3,891,842 | 6/1975 | Strusinski | 362/18 X |
| 3,927,313 | 12/1975 | Herold | 362/804 |
| 4,025,778 | 5/1977 | Hayakawa | 362/287 X |
| 4,037,096 | 7/1977 | Brendgord et al. | 362/294 |

*Primary Examiner*—Benjamin R. Padgett
*Assistant Examiner*—J. L. Barr
*Attorney, Agent, or Firm*—Charles L. Lovercheck

[57] ABSTRACT

A multi-filament lamp combination is disclosed which may be used alone and in multi-lamp arrangements with other single and multi-filament lamps to provide pattern size variation from a large diameter flood effect to a smaller diameter spot effect. A spot/flood capability exists to provide large pattern exposure simultaneously with secondary spotlighting. The filaments can be energized selectively from a remote switching station so that the individuals who are scrubbed and gloved need not touch any part of the switching arrangement to change the lamp pattern size. A cluster of lights can contain one or more multi-filament lamps within the cluster, so that by switching on the rear most filament of the multi-filament lamps and switching off the single filament lamps, a small high intensity pattern is obtained by switching to the other filaments, a large pattern of high intensity is formed. More than two filaments can be provided in each lamp.

18 Claims, 7 Drawing Figures

ELECTRICALLY FOCUSED SURGICAL LIGHT

REFERENCE TO PRIOR ART

The light disclosed herein constitutes an improvement over the surgical lamp shown in U.S. Pat. No. 4,037,096 and U.S. Pat. No. 4,025,778. The latter patent shows a plurality of lights that are arranged mechanically to change the position of the focus of the lights. This requires complex apparatus and considerable physical effort. Double filament bulbs, such as shown in U.S. Pat. No. 2,005,194 and U.S. Pat. No. 3,493,806, are not new, per se. However, the applicants have discovered that by switching on filaments at different distances from the reflector, the pattern of light from the lamp on an object on a surgical table can be changed.

GENERAL STATEMENT OF THE INVENTION

In the specialized lighting utilized for surgical procedures, it is frequently desirable to be able to adjust the pattern size of the light pattern on the wound site depending upon the particular procedure being used and/or the progress of the operation during the surgical procedure.

The conventional means of accomplishing a change in focus and/or a change in pattern size is by mechanical movement of the bulb relative to the reflector or reflectors of the optical system. This normally involves utilization of a lever or levers located on the light itself in order to initiate physical lamp source displacement. Since the lever or levers are not sterilized prior to the surgical procedure, it would be a break in technique if any of those individuals who are scrubbed and gloved should touch such levers to vary focus or pattern. Thus, such focus means are inconvenient. To provide for remote operation of focus would require a very cumbersome motor drive being mounted on the light.

This invention provides a means for controlling the pattern size and/or focus of such surgical lighting without the requirement for mechanical movement thereby facilitating remote operation and control.

FIG. 1 indicates a typical surgical light. This disclosure envisions the use of a bulb with two or more filaments spaced a predetermined controlled distance apart vertically relative to the axis of the optical system. The design allows for dual filament capability in small lamp envelope packing configurations. Previous designs were of the standard incandescent variety, which were bulky and suffered from shortcomings of lumen depreciation and reduced life. The lamps employed herein are the frosted, low voltage type using the multiple filament technology to overcome these negative attributes. Also, the associated small envelope approximates a point source and allows its use in multireflective systems offering a greater range in pattern/focus selection. The curvative of the reflector may be parabolic with the filaments located between the reflector and the focal point of the reflector, so that the rays of light come to focus at the finite point.

By energizing one or the other of the filaments, the focus and, therefore, the pattern size can be changed electrically. As a side benefit to this arrangement, in the event a filament should burn out during a surgical procedure, the light could be switched over to another filament and the surgical procedure continued without having to pause to relamp the light. (In particular, there are some countries that require such standby lighting capability in surgical lighting).

A cluster of lights could contain one or more multifilament lamps within the cluster. Therefore, by switching to the rearmost filament on the multi-filament lamps and switching off some of the lamps, a small pattern of high intensity can be obtained. By switching to the other filament, switching on additional lamps, a large pattern of high intensity can be formed. This design opposed to multicluster systems, which decrease overlap fixed projections from the various lamps and pattern size by switching off lamps. In this case, intensity is decreased as the pattern become smaller. Two or more filaments may be placed within any lamp. Therefore, the application can be expanded to include a multitude of patterns.

A derivative of this system has applicability to the field of photographic lighting. It is well known that the two principal types of lighting used by photographers are "Flood" and "Spot". At present, the photographer has to buy two different bulbs for these two applications and change bulbs when the lighting requirements or the subject change.

When a basic bulb is provided with two filaments, displaced a certain actual distance apart, the light can be switched from Spot to Flood and back to Spot again electrically. Thus, a means is disclosed of electrically switching a bulb from "Flood" to "Spot" for maximum flexibility in photographic lighting.

OBJECTS OF THE INVENTION

It is an object of the invention to provide an improved surgical light.

Another object of the invention is to provide a means of electrically controlling the pattern size of a surgical light by the utilization of a multiple filament bulb with suitable means to activate one filament or another. This provides a means for the pattern size to be changed by remote control without anyone having to physically touch the light itself.

Another object of the invention is to provide a multiple filament lamp to provide a light capable of providing an electrical variation in the pattern size and/or focus without requirement of mechanical moving parts and at the same time couple the lamp to an automatic intensity control such that intensity is adjusted proportional to pattern size so that brightness illumination can be automatically maintained constant as the pattern size changes.

Another object of the invention is to provide a multiple filament lamp designed to provide for electrical adjustment of focus and/or pattern size and also has built-in redundancy such that in the event of a filament failure, the surgical procedure can be continued by switching to another filament (and at the same time another pattern).

Another object of the invention is to provide a means to utilize a lamp with two or more filaments arranged perpendicular to the optical axis to the light in such a fashion that one or more of the filaments can be energized simultaneously to provide specialized patterns for specialized surgical procedures.

Another object of the invention is to provide a surgical lamp that can be refocused simply by switching on a different filament.

Another object of the invention is to provide a surgical light that is simple in construction, economical to manufacture and simple and efficient to use.

Another object of the invention is to provide a cluster of lamps, some having several filaments.

With the above and other objects in view, the present invention consists of the combination and arrangement of parts hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
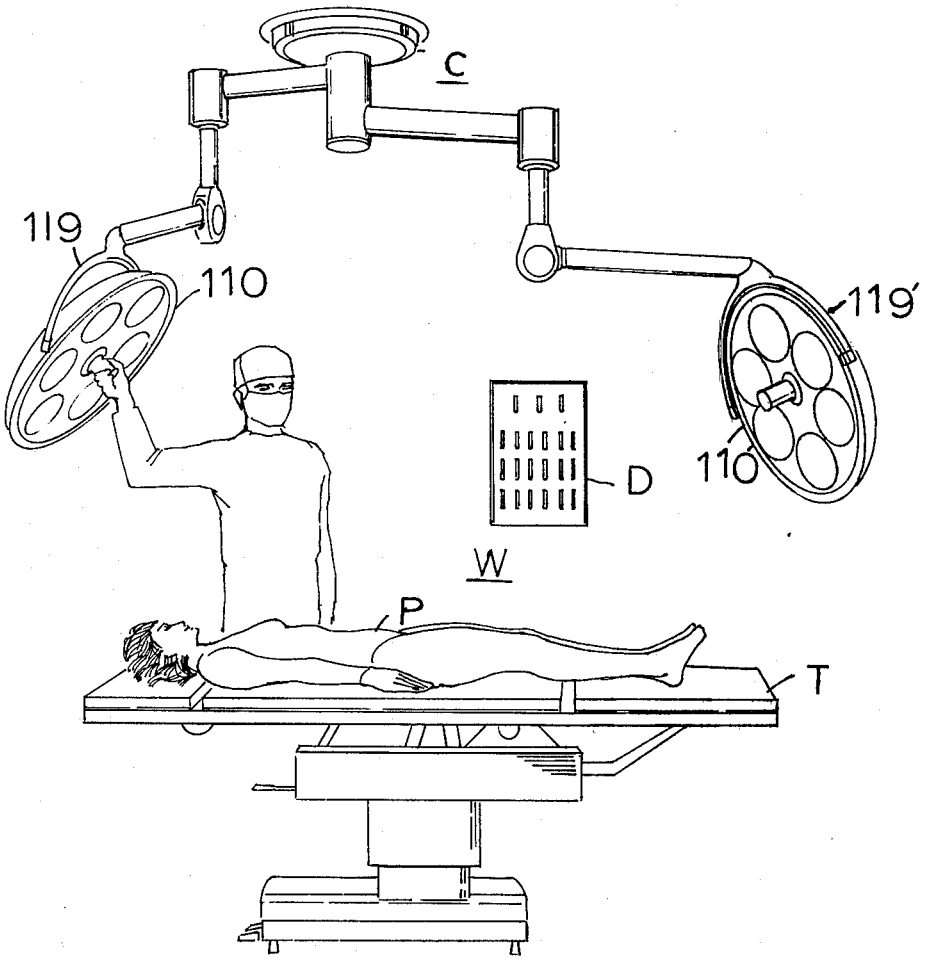
FIG. 1 is an illustrative view of a surgical light according to the invention shown in a use environment.

Now with more particular reference to the drawings, FIG. 1 shows surgical lights 110 and 110' supported by means of suitable arms on the ceiling of the hospital room to provide adjustment of the position of the light. A surgical table T is shown below the lights on which a patient may be supported which for purposes of illustration, will be considered to be the object on which the light patterns are to be projected.

The light switch panel D is supported at any convenient position on the wall near the surgical table where it will be readily accessible to the operator. The lamps in Lights 110 and 110' can be switched to energize all the filaments of the lamps of both Lights 110 and 110', or part of the filaments of each lamp to give a large light pattern, a small light pattern or any combination of large and small light patterns that may suit the particular requirements of the operator. The word surgical light is intended to include dental lamps and lights used in other areas of the health care field.

Figure 1A:
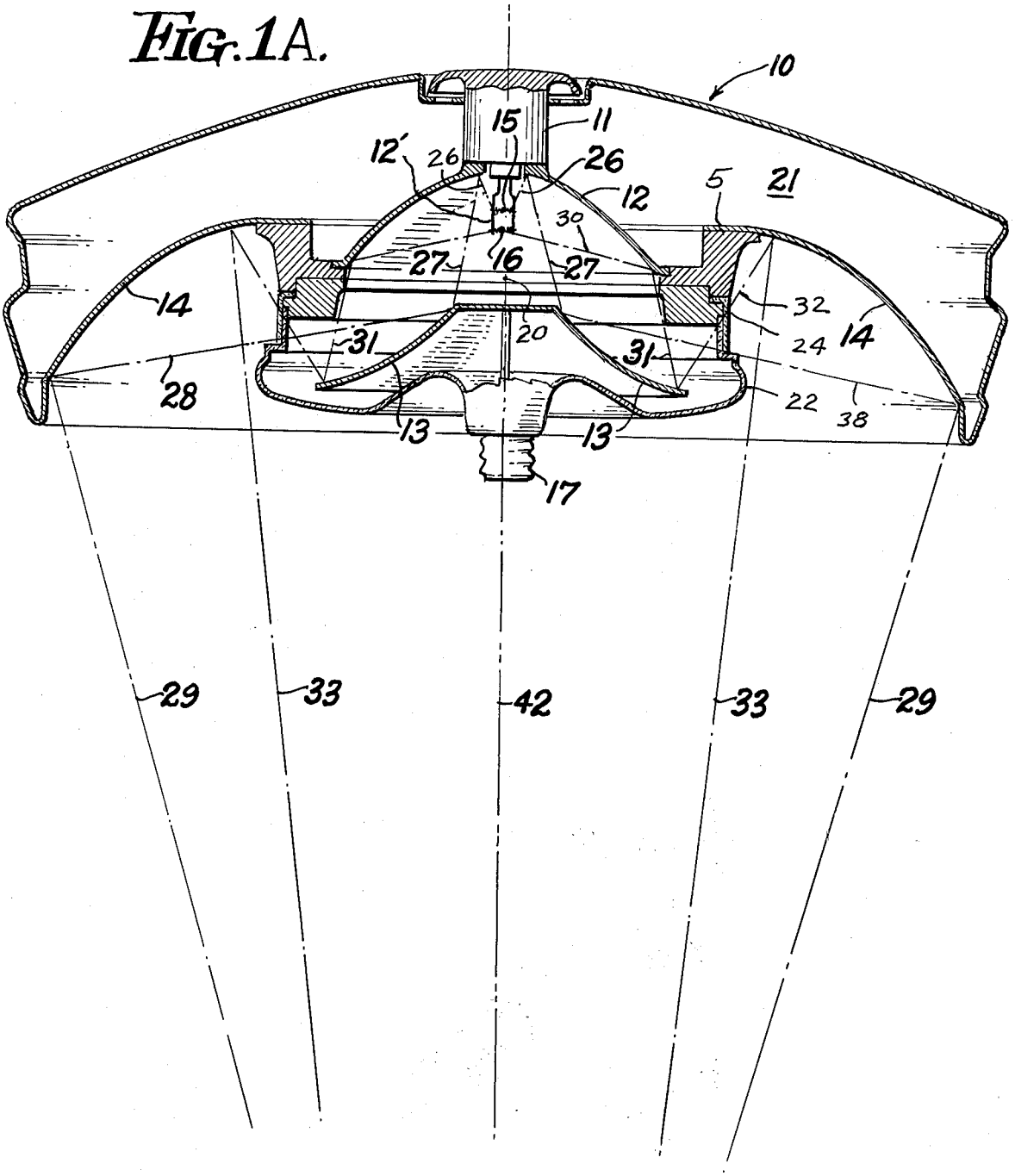
FIG. 1A is a view of a surgical light with a multi-filament lamp according to the invention.
Figure 2:
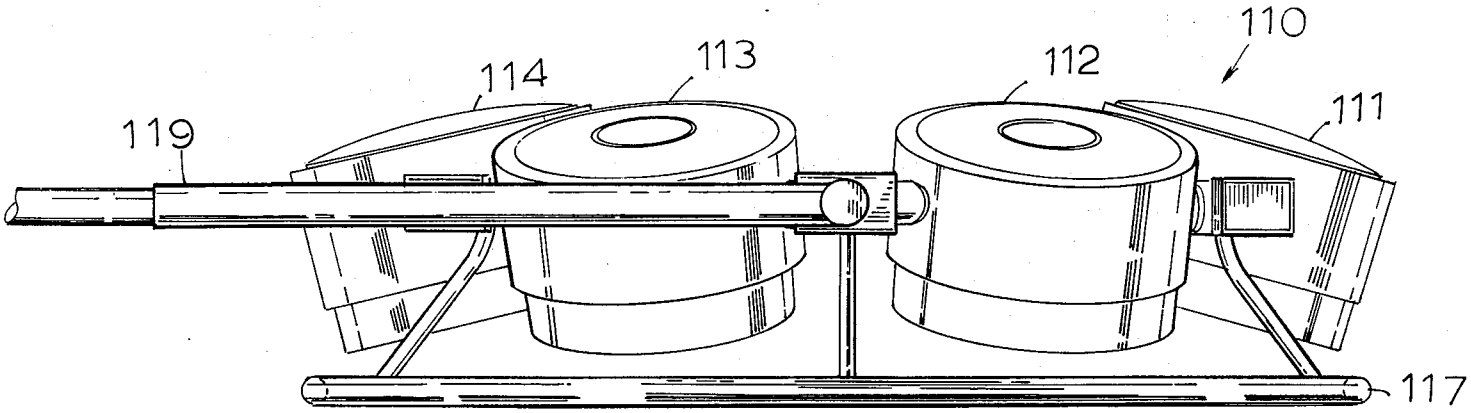
FIG. 2 is a side diagrammatic view of a cluster of multi-filament lights.
Figure 3:
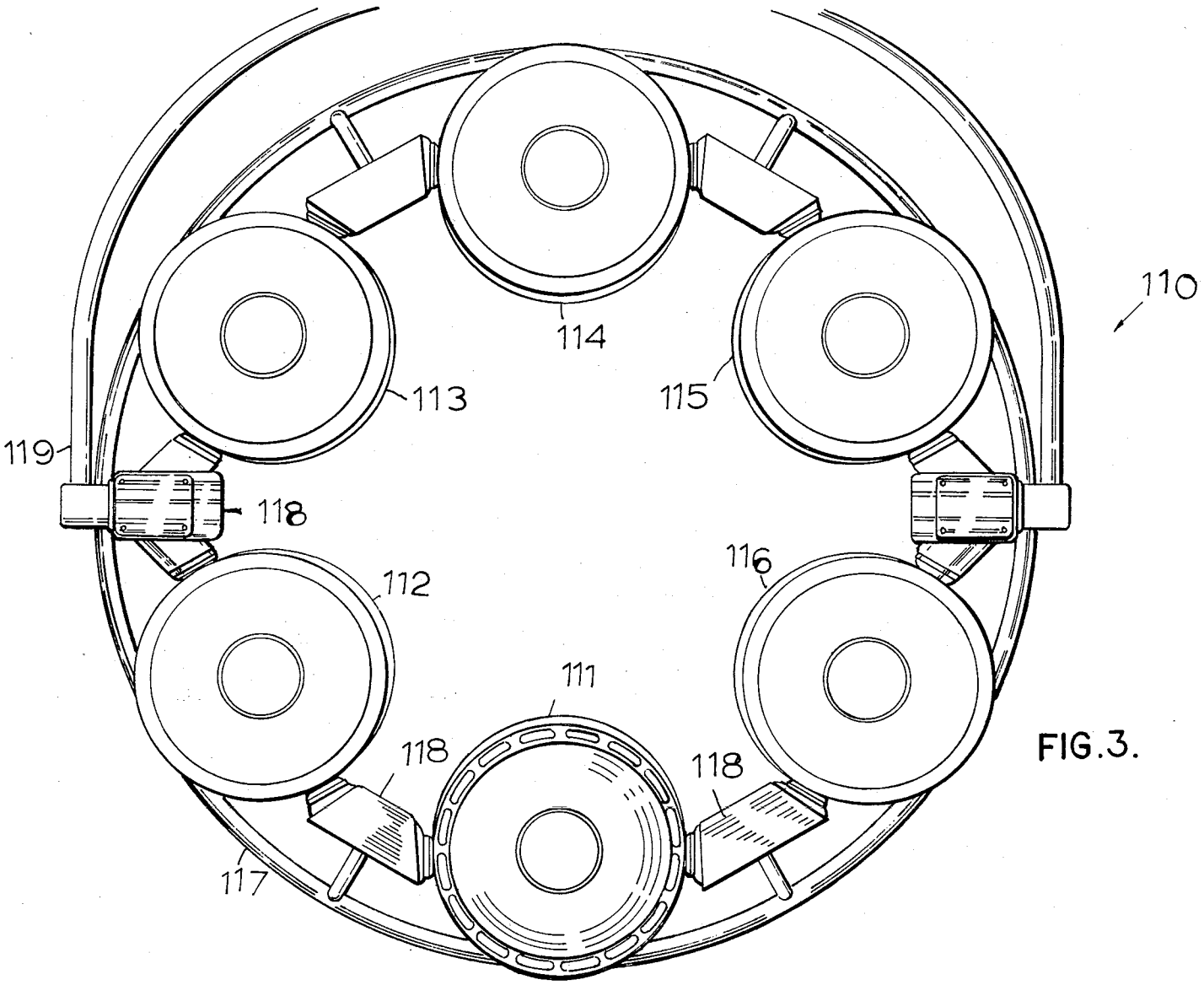
FIG. 3 is a top view of a cluster of lights shown in FIG. 2.
Figure 4:
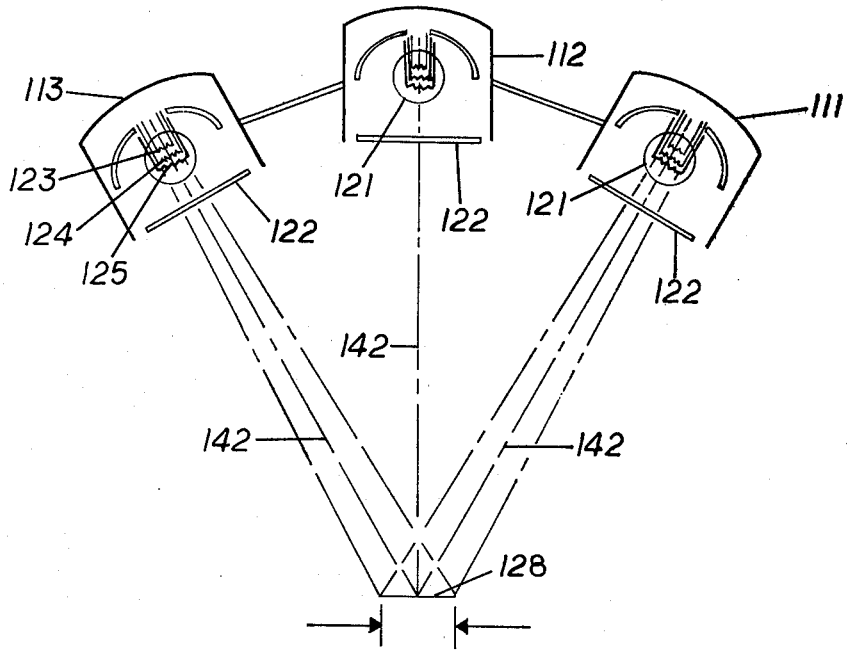
FIG. 4 is a diagrammatic view of the lights of FIGS. 2 and 3 with the lamps energized to form a small pattern of light.
Figure 5:
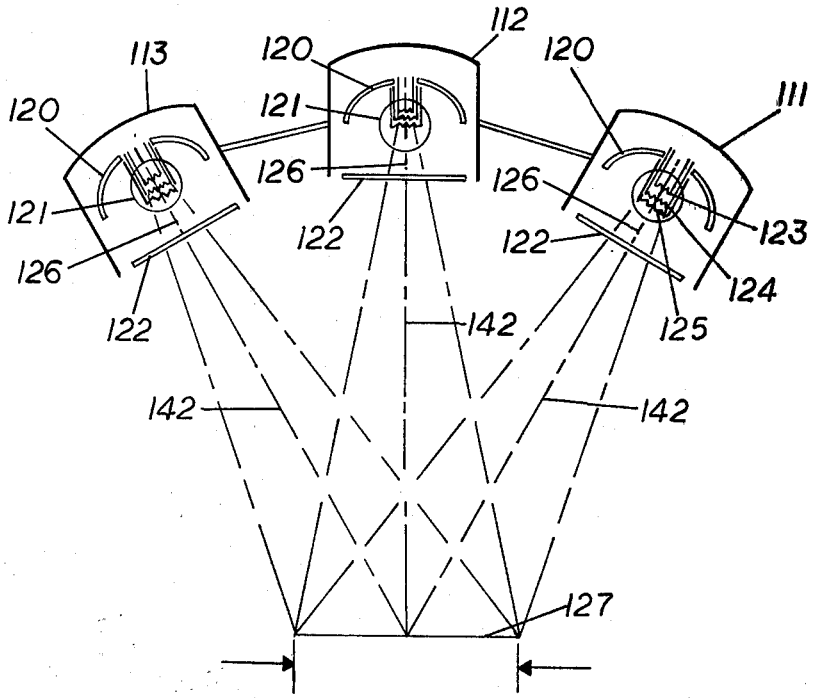
FIG. 5 shows the lights of FIGS. 2, 3 and 4 energized to form a large pattern of light.
Figure 6:
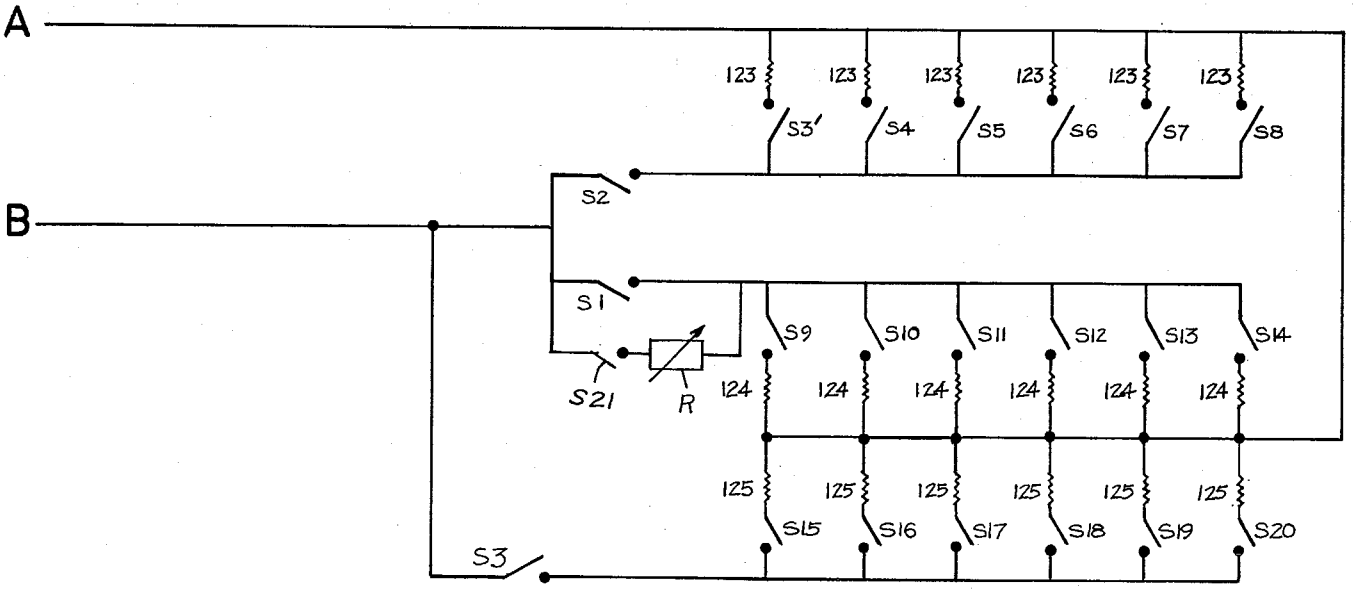
FIG. 6 is a schematic wiring diagram of an example of switching connections to the several filaments.

The surgical light 10 shown in FIG. 1A has a housing 11 which may be supported on a suitable bracket. The lamp shown in FIG. 1A is a multi-reflector type light, but could be a single reflector type. The housing 11 supports a first source reflector 12, a lamp 12', second reflector 13 and third reflector 14, the handle 17 is attached to the lamp housing by suitable structure. Source reflector 12 has a focal point 20 and an axis of symmetry 42, which will be understood by those skilled in the art. The filaments which can be any suitable light sources will preferably be spaced from the focal point of reflector 12. The reflector 12, 13, and 14 may have a plain reflecting surface, a diffusing type reflector surface or a faceted surface. Lamp 12' contains the first light source 15, the second 16 and could contain three or more light sources. Light source 15 and 16 could be made of any suitable material used for filaments or light generating elements familiar to those skilled in the art and will be referred to herein generally as filaments. The tungsten halogen material has been found to be a desirable type filament because of its compact size, approximating a point source with two or more filaments spaced a controlled distance from each other. It will be noted that the first light source 15 is spaced from the first reflector 12 between reflector 12 and focal point 20 and spaced from the second light source 16. The second filament 16 is shown spaced from the first filament 15 and the focal point 20.

The multi-filament lamp 12' may have a frosted glass envelope, to obtain patterns which are free of voids or shadows and preclude filament imaging at the pattern site. A clear lamp may also be employed in conjunction with faceted reflector 12 and/or variable stepped Fresnel lenses to provide the desired diffusion of light.

The handle 17 may be a removable, sterilizable handle of a type familiar to those skilled in the art which may be grasped by the hand of the operator to adjust the surgical light to the desired position.

When the first filament 15 of the surgical light of FIG. 1A is energized, a typical light ray 26 will be reflected by reflectors 12, 13 and 14 through paths 27, 28 and 29 in a large pattern size onto an object. When second filament 16 is energized, the ray of light from the filament 16 may be reflected through paths 31, 32 and 33 to give a smaller light pattern size on an object. Energizing other filaments could result in an intermediate pattern size, a smaller pattern size or a larger pattern size, thus by energizing the filaments 15 or 16, selectively different pattern sizes of light are obtainable.

In the embodiment of the invention shown in FIG. 2 through 5, we show a surgical light 110 made up of light elements 111, 112, 113, 114, 115 and 116 arranged in a circle and supported on frame 117 by brackets 118 supported on yoke 119 which may be attached to a suitable supporting surface such as a wall W or ceiling C above a surgical table T. The table T may support an object such as a patient P. Each of the lights 111 through 116 has a reflector 120. Reflectors 120 are concave and have a focal point 121 in accordance with good lighting practice. Lenses 122 are provided which may be frosted, clear or color corrected. Each of the light elements 111 through 116 has a lamp 121 which is shown by way of example as having a plurality of filaments 123, 124 and 125 spaced from each other and spaced from the focal point 126. Each of the light elements 111 through 116 could have two or more filaments and they are shown with these filaments by way of examply only. The filaments 123 and 124 are spaced from the focal point and from the reflector a different distance along the axis of symmetry 142 and the reflectors 120 are so directed that when the filaments 124 are energized, the light is directed into a relatively small pattern 128 on the object T at a relatively high intensity. Only part of the filaments 124 need be energized when the small pattern size is desired because the pattern size being smaller only a portion of the light is required to result in the same pattern intensity.

When the filaments 123 of the lights are energized by closing switch S2, they direct light onto an object in a relatively large pattern, indicated at 127, and in order to provide a higher intensity pattern of light over the large pattern area 127, other filaments of lamps may be energized by closing switch S3 for example.

Any suitable number of light elements can be provided in the surgical light 110, and the light elements 111 through 116 can be supported in any practical configuration or any practical number of lights can be used, in any desired pattern each light in the array having several filaments and each light reflector aimed at the ame area on an article on a surgical support, each of the light elements 111 through 116 being arranged about the axis of symmetry 142.

The lights can be used for flood lights, dental lights, photography lights or under application requiring variable focus or variable pattern size.

The Dual Filament Lamp can be utilized in a multi-lamp arrangement with other single or multi filament lamps to provide pattern size variation from a large diameter flood effect to a smaller diameter spot effect. In addition, a combination flood/spot capability exists to provide large pattern exposure with secondary spot lighting simultaneously. In such a manner, large surface incisions can be lighted while also providing depth of illumination into smaller surgical cavities. Any variation from total flood or total spot to flood/spot combination can be performed by selective electrical energization of the proper filaments.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A light comprising a reflector means having an axis of symmetry, a first light source and a second light source means supporting said first light source and said second light source on said axis of symmetry and at predetermined distances from said reflector means and in spaced relation to each other one said light source being located closer to said reflector than the other and in spaced relation to said reflector means, and means connected to said light source and said second light source, whereby a relatively small light pattern or a relatively large light pattern may be selectively directed onto an object while said reflector and said first light source and said second light source remains stationary.

2. The light recited in claim 1 wherein said reflector means comprises a concave reflector having a focal point and at least one of said light sources is supported at predetermined distances from said focal point.

3. The light recited in claim 2 wherein said reflector means comprises, a first reflector having said focal point, a second reflector and a third reflector, said first reflector being disposed to direct light from said light source to said second reflector, said second reflector being disposed to direct light from said first reflector to said third reflector, said third reflector being disposed to direct light from said third reflector onto an object whereby said relatively small light pattern or a large relatively light pattern can be selectively directed onto said object.

4. The light recited in claim 1 wherein said light sources comprise tungsten halogen filaments.

5. A surgical light comprising a cluster of light elements, each said light element comprising a reflector means having an axis of symmetry, a first light source and a second light source, means supporting said light sources on said axis of symmetry and in spaced relation to each other one said light source being located closer to said reflector than the other and to said reflector means, and means for selectively connecting said first light source means and said second light source means selectively to source of energy to selectively energize said first light source means and said second light source means whereby, a spot of light or a flood of light are selectively directed onto an object while said first light source and said second light source and said reflector remain stationary.

6. The light recited in claim 5 wherein said reflector means comprises concave reflectors having a focal point, and said light sources are supported at a predetermined distance from said focal point.

7. The light recited in claim 5 wherein said light sources are filaments.

8. The light recited in claim 7 wherein said filaments are tungsten halogen filaments.

9. The light recited in claim 5 wherein at least six said light elements are supported on said light and disposed generally in a circle.

10. The light recited in claim 9 wherein said light elements are supported on a circular frame and said circular frame is supported on a yoke adapted to be attached to a wall or ceiling.

11. In combination a surgical light and a surgical table said surgical light comprising a cluster of light elements, each said light element comprising a reflector means having an axis of symmetry, a first light source and a second light source, means supporting said light sources on said axis of symmetry and in space relation to each other one said light source being located closer to said reflector than the other and to said reflector means, and means for selectively connecting said first light source means and second light source means to a source of energy to selectively energize said first light source and said second light source whereby a relatively small pattern of light or a relatively large pattern of light are selectively directed onto an object supported on said surgical table while said first light source and said second light source remain stationary.

12. The combination recited in claim 11 wherein a said means for selectively connecting said first light source and said second light source means to a source of energy comprises switch means, means supporting said switch means at a position remote from said light and remote from said surgical table.

13. The combination recited in claim 5 wherein said reflector means comprises a concave reflector having a focal point, and said light sources are supported at a predetermined distances from said focal point.

14. The combination recited in claim 12 wherein said light sources are filaments.

15. The combination recited in claim 13 wherein said filaments are tungsten halogen filaments.

16. The combination recited in claim 14 wherein at least six said light elements are supported on said light and said light elements are supported generally in a circle.

17. A light for use in photography for providing photographers with flood and spot lights said lights comprising a reflector having an axis of symmetry and a focal point, a first light source and a second light source said first light source and said second light source being supported in spaced relation to said reflector and in spaced relation to each other one said light source being located closer to said reflector than the other and means for selectively connecting a source of energy to said sources whereby a spot of light can be selectively directed onto an object and a flood of light can be selectively directed on said object while said first light source and said second light source remain stationary, thereby providing means for switching a lamp from flood to spot for maximum flexibility in photographic lighting.

18. The combination recited in claim 16 wherein said surgical lamp has a circular frame, said light elements are disposed within said circular frame, brackets supporting said light elements to said circular frame, a yoke, said yoke being attached, connected to said circular frame and means on said yoke for connecting said yokes to a building member.

* * * * *